United States Patent [19]

Gurcan et al.

[11] Patent Number: 4,970,477

[45] Date of Patent: Nov. 13, 1990

[54] MICROWAVE ADJUSTMENT DEVICE FOR A TRANSITION BETWEEN A HOLLOW WAVEGUIDE AND A PLANE TRANSMISSION LINE

[75] Inventors: Mustafa Gurcan, Cergy Le Haut; Patrick Menuge, Argenteuil, both of France

[73] Assignee: Alcatel N.V., Amsterdam, Netherlands

[21] Appl. No.: 327,303

[22] Filed: Mar. 22, 1989

[51] Int. Cl.[5] ..... H01P 5/107

[52] U.S. Cl. ..... 333/26; 333/33

[58] Field of Search ..... 333/26, 33

[56] References Cited

U.S. PATENT DOCUMENTS

| | | | |
|---|---|---|---|
| 3,020,500 | 2/1962 | Beiser et al. | 333/226 |
| 4,679,249 | 7/1987 | Tanaka et al. | 455/328 |
| 4,814,729 | 3/1989 | Becker | 333/33 X |

FOREIGN PATENT DOCUMENTS

| | | | |
|---|---|---|---|
| 0069651 | 1/1983 | European Pat. Off. . | |
| 0281781 | 9/1988 | European Pat. Off. . | |
| 1918356 | 10/1970 | Fed. Rep. of Germany . | |
| 3637398 | 6/1987 | Fed. Rep. of Germany . | |
| 1408081 | 9/1964 | France . | |
| 113501 | 6/1985 | Japan | 333/33 |
| 182801 | 9/1985 | Japan | 333/33 |
| 247301 | 12/1985 | Japan | 333/26 |
| 721701 | 1/1955 | United Kingdom | 333/33 |
| 849490 | 9/1960 | United Kingdom . | |

OTHER PUBLICATIONS

Mazilu, Tiberiu; "A Self-Adjusting Waveguide to Microstrip Transition", *Microwave Journal*; Jul. 1987, pp. 133,134.

*Primary Examiner*—Eugene R. LaRoche
*Assistant Examiner*—Benny T. Lee
*Attorney, Agent, or Firm*—Christie, Parker & Hale

[57] ABSTRACT

A microwave adjustment device for a transition between a hollow waveguide (11) and a plane transmission line (10), the device comprising: an intermediate coaxial waveguide (12) comprising a core (20) whose first end opens out into the hollow waveguide and terminates in an antenna (23) and whose second end passes through the substrate on which the plane transmission line is deposited; a curved metal tape (26) having a first end fixed to the second end of the core (20); and a screw (27) fixed to the second end of a tape (26) in order to adjust the gap between the second end and the transmission line (18). The invention is applicable to microwave beam telecommunications.

8 Claims, 2 Drawing Sheets

MICROWAVE ADJUSTMENT DEVICE FOR A TRANSITION BETWEEN A HOLLOW WAVEGUIDE AND A PLANE TRANSMISSION LINE

The invention relates to a microwave adjustment device for a transition between a hollow waveguide and a plane transmission line.

BACKGROUND OF THE INVENTION

The invention consists in providing a structure for matching or adapting the impedance of plane transmission lines that need to go through a substrate.

The device of the invention is applicable to all high frequency applications and in particular to microwaves and to microstrip technology.

When transmitting or receiving microwave signals, it is often necessary to go from a hollow waveguide to a plane transmission line, e.g. a microstrip. This is conventionally done either by means of a coaxial waveguide whose core is extended by an antenna in order to provide electrical coupling (coupling parallel to the $TE_{10}$ electric field of a ractangular waveguide or the $TE_{11}$ electric field of a circular waveguide) or else by means of a magnetic coupling loop placed on the narrow side of the waveguide. The other end of the core is perpendicular to a face of a substrate to which it is bonded. In devices where transmission and reception occur simultaneously, or where two orthogonally polarized waves co-exist, it may be necessary to pass through the substrate because of constraints on mechanical implementation.

The object of the invention is to make such an implementation possible.

SUMMARY OF THE INVENTION

The present invention provides a microwave adjustment device for a transition between a hollow waveguide and a plane transmission line, the device comprising:

- an intermediate coaxial waveguide comprising a core whose first end opens out into the hollow waveguide and terminates in an antenna and whose second end passes through the substrate on which the plane transmission line is deposited;
- a curved metal tape having a first end fixed to the second end of said core; and
- a screw fixed to the second end of tape in order to adjust the gap between said end and said transmission line.

The invention provides a solution to inlet matching problems between a coaxial waveguide and a plane transmission line while introducing very little loss (loss less than 0.4 dB in the KU band, reflection losses less than −20 dB).

Advantageously, the hollow waveguide is rectangular, and the core disposed parallel to the two sides of said waveguide passes through the substrate perpendicularly to the two faces of the substrate; the substrate is metal coated on its face opposite to its face on which the transmission line is deposited, and includes a non-coated zone where the core passes through; the coaxial waveguide comprises two successive portions, with the portion closer to the plane transmission line having air as its dielectric; and screening is disposed over that side of the substrate on which the transmission line is printed, with the screw being made of insulating material and being fixed to said screening.

The device of the invention can be used to go from one propagation mode to another propagation mode while retaining a good standing wave ratio (SWR), thereby making it possible to have a very good noise factor over a very wide bandwidth, e.g. 10.7 GHz to 12.75 GHz, for preamplifier applications.

BRIEF DESCRIPTION OF THE DRAWINGS

An embodiment of the invention is described by way of example with reference to the accompanying drawings, in which.

DETAILED DESCRIPTION

Figure 1:
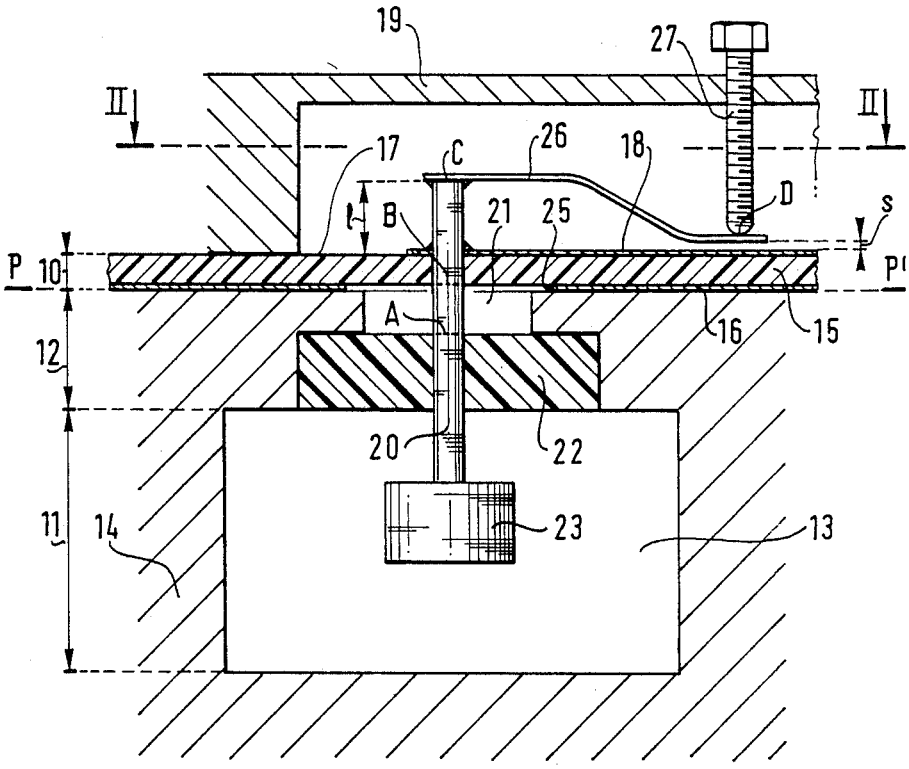
FIG. 1 is a diagram of a device in accordance with the invention.
Figure 2:
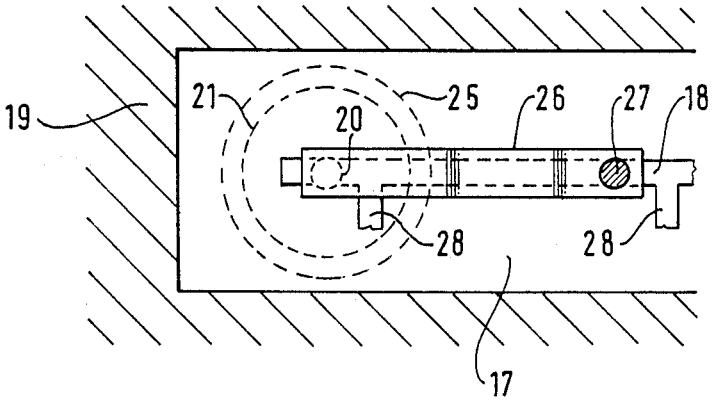
FIG. 2 is a section view through the device in accordance with the invention on plane II—II of FIG. 1.

As shown in FIGS. 1 and 2, the device serves to provide a transition between a waveguide 11 and a plane transmission line 10, e.g. a microstrip, via a coaxial waveguide 12.

The waveguide 11 is constituted, in this case, by a rectangular cavity 13 formed in a housing 14.

The plane transmission line 10 is made in the form of a substrate 15 whose first face 16 is metal coated and whose second face 17 carries the signal-conveying transmission line 18, with screening 19 being placed over said transmission line.

The coaxial waveguide 12 is constituted by a metal core 20 which passes successively through a dielectric plate 22 and an empty zone 21 in order to form an air-insulated coaxial line. The core 20 runs parallel to the side faces of the cavity 13 of the waveguide 11 and terminates at a first end in the form of a metal antenna 23 disposed inside said cavity 13. The other end of the core 20 passes through the substrate 15 perpendicularly to its faces.

The antenna 23, the core 20, and the dielectric 22 constitute a conventional electrically-coupled transition between a hollow-waveguide and a coaxial waveguide. It would be equally possible to use a magnetically-coupled transition. The diameter of the core 20 cannot be uniform over its entire length. The portion of the core situated between points A and B constitutes an air-insulated coaxial waveguide, thereby preventing the dielectric 22 from bearing against the substrate 15 and deforming it during manufacture, and also being dimensioned so as to reduce the effects of the dielectric-to-air discontinuity. The length AB may, indeed, be variable.

At point B, in the plane PP', the first face 16 of the substrate 15 is stripped of its metal coating over a circular zone 25 which can be seen more clearly in FIG. 2.

The core 20 of the coaxial transmission line 12 is bonded to the second face of the metal coated substrate 15.

The core 20 extends above the second face 17 of the metal coated substrate 15 by a certain length l where $l \leqq \lambda/4$, and $\lambda$ is the length of the wave guided in the transmission line.

The second end C of the core 20 is bonded (e.g. soldered or screwed) to a first end of a curved tape 26 whose width depends on the desired impedance and whose length is little different from $\lambda/2$.

The second end D of the tape 26 is bonded (glued or soldered) to the end of a non-conducting screw 27 for adjusting the gap S between the printed transmission line 18 and the conducting line 26.

Screening 19 serves to reduce radiation losses. Two stubs 28 (FIG. 2) are disposed on one side of the line 18 in order to provide fine adjustment.

Figure 3:
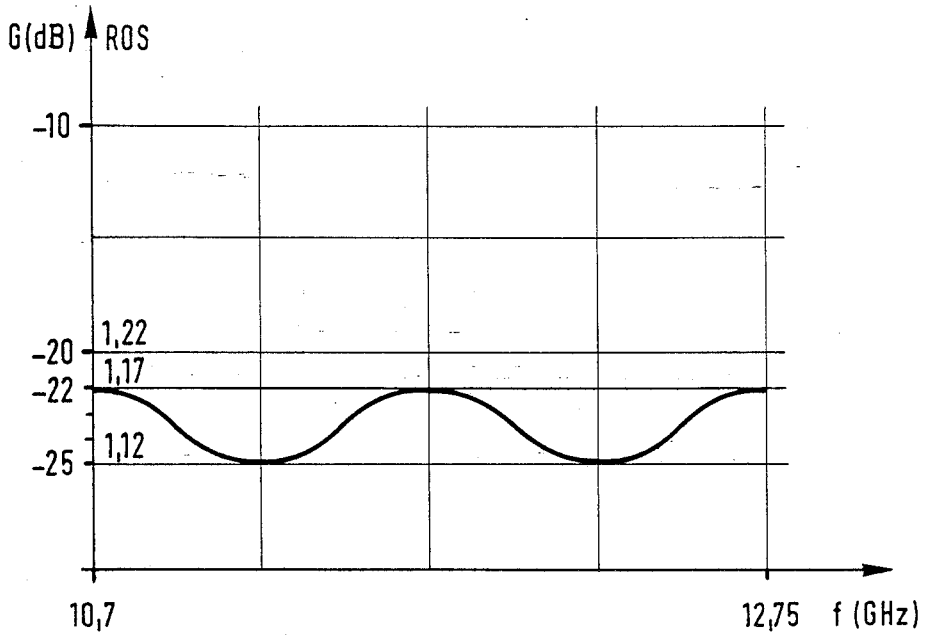
FIG. 3 is a graph showing the operation of the device in accordance with the invention.

Losses in the device of the invention are low: as shown in FIG. 3, they lie between −22 dB and −25 dB. In other words, the device provides a progressive transition for the TEM mode field in the coaxial guide 12 to the quasi-TEM mode field in the plane transmission line 10 extending orthogonally to the coaxial waveguide by virtue of the geometry used, with the coupling combining electrical coupling and magnetic coupling.

Its low loss characteristics make the invention particularly advantageous for use at the inlet to low noise amplifiers.

In this application, the invention has an additional advantage since its flexibility in adjustment makes it possible to have a wide range of impedances, thereby facilitating obtaining an optimum source impedance for minimizing noise.

Dispersion in etching the circuit 10 and mechanical tolerances are also compensated without any need to add additional losses.

Naturally the present invention has been described and shown merely by way of preferred example and its component parts could be replaced by equivalent parts without thereby going beyond the scope of the invention.

We claim:

1. A microwave adjustment device for a transition between a hollow waveguide and a plane transmission line deposited on an upper surface of a generally horizontal substrate located above the hollow waveguide, the device comprising:

an intermediate coaxial waveguide comprising a core having a lower end extending into the hollow waveguide and an upper second end passing through the substrate and extending above the plane transmission line;

an antenna at the lower end of the core;

a curved metal tape having a first end fixed to the upper end of the core and a second end extending above and generally parallel to the plane transmission line to thereby define a gap between a lower surface of the metal tape and an upper surface of the plane transmission line; and a vertical screw having a lower end in contact with said second end of the tape for adjusting the height of said gap between said second end and said transmission line.

2. A device according to claim 1, wherein the hollow waveguide is rectangular in vertical cross-section, and the core is disposed parallel to two vertical sides of said hollow waveguide and passes through the substrate perpendicular to the upper surface of the substrate.

3. A device according to claim 1, wherein the substrate has a lower surface which is metal coated except for a non-coated zone surrounding the core where the core passes throught the substrate.

4. A device according to claim 3, wherein the non-coated zone is circular in horizontal cross-section.

5. A device according to claim 1, wherein the coaxial waveguide comprises two successive portions, each portion having a different dielectric surrounding said core, with the portion of the coaxial waveguide closer to the plane transmission line having air as its dielectric.

6. A device according to claim 1, further comprising a conductive screening above the transmission line, wherein the screw is made of insulating material and has a second end adjustably fixed to said screening.

7. A device according to claim 1, wherein the tape has a length of approximately $\lambda/2$, where $\lambda$ is the length of the wave as guided in the transmission line.

8. A device according to claim 1, wherein the core extends above the upper surface of the substrate by a distance of not more than $\lambda/4$, where $\lambda$ is the length of the wave guided in the transmission line.

* * * * *

UNITED STATES PATENT AND TRADEMARK OFFICE

CERTIFICATE OF CORRECTION

PATENT NO. : 4,970,477

DATED : November 13, 1990

INVENTOR(S) : M. Gurcan; P. Menuge

It is certified that error appears in the above-identified patent and that said Letters Patent is hereby corrected as shown below:

Column 1, line 24, change "ractangular" to -- rectangular --.

In the Claims

Column 4, line 22, change "throught" to -- through --.

Signed and Sealed this

Fourth Day of August, 1992

*Attest:*

DOUGLAS B. COMER

*Attesting Officer*

*Acting Commissioner of Patents and Trademarks*